US009534779B2

(12) United States Patent
Wepfer

(10) Patent No.: US 9,534,779 B2
(45) Date of Patent: Jan. 3, 2017

(54) STEAM GENERATOR TUBE LANE FLOW BUFFER

(75) Inventor: Robert M. Wepfer, Export, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 1509 days.

(21) Appl. No.: 13/197,890

(22) Filed: Aug. 4, 2011

(65) Prior Publication Data

US 2012/0247727 A1 Oct. 4, 2012

Related U.S. Application Data

(60) Provisional application No. 61/471,328, filed on Apr. 4, 2011.

(51) Int. Cl.
*F22B 37/20* (2006.01)
*F22B 1/02* (2006.01)

(52) U.S. Cl.
CPC ..... *F22B 1/025* (2013.01); *F22B 37/205* (2013.01)

(58) Field of Classification Search
CPC ..... F22B 1/025; F22B 37/205
USPC ..... 165/134.1, 162, 158, 161, 69
See application file for complete search history.

(56) References Cited

U.S. PATENT DOCUMENTS 1,883,605 A * 10/1932 Humphrey ..... F22G 1/005 122/483
1,987,891 A * 1/1935 Cattanach ..... F28D 7/0058 165/11.1
2,279,552 A * 4/1942 Bowman ..... F22G 5/16 165/110
2,805,049 A * 9/1957 Katholi ..... F28F 9/0131 165/159
2,946,570 A * 7/1960 West ..... F22D 1/32 165/110
3,147,743 A * 9/1964 Romanos ..... F22B 1/021 122/32
3,465,727 A * 9/1969 Tidball ..... F22B 1/063 122/32
3,483,848 A * 12/1969 Green ..... F22B 1/025 122/32
3,545,536 A * 12/1970 Perrin ..... F22B 1/063 122/32
3,706,301 A * 12/1972 Penfield, Jr. ..... F22B 1/025 122/32
3,807,365 A * 4/1974 Lyman ..... F22B 1/025 122/32
3,867,908 A * 2/1975 Byerley ..... F22B 1/025 122/32
3,868,994 A * 3/1975 Petrek ..... 165/142
(Continued)

OTHER PUBLICATIONS

International Preliminary Report on Patentability for PCT/US2012/035169 dated Oct. 8, 2013 (Form PCT/IB/373, PCT/ISA/237).

*Primary Examiner* — Jianying Atkisson
*Assistant Examiner* — Kirstin Oswald
(74) *Attorney, Agent, or Firm* — Joseph C. Spadacene; Westinghouse Electric Company LLC

(57) ABSTRACT

A tube and shell steam generator in which a series of rods having a diameter substantially equal to that of the heat exchange tubing in the tube bundle are placed on either side of the tube lane to buffer the flow in the tube lane from the heat exchange tubes to attenuate turbulent forces on the first several rows of heat exchange tubes adjacent to the tube lane.

15 Claims, 4 Drawing Sheets

(56) References Cited

U.S. PATENT DOCUMENTS 3,907,026 A * 9/1975 Mangus ..... F22B 1/063 165/104.19
3,916,843 A 11/1975 Bennett
3,942,481 A * 3/1976 Bennett ..... F22B 37/483 122/32
4,143,709 A 3/1979 Cunningham
4,173,997 A * 11/1979 Andrews et al. ..... 165/158
4,200,061 A * 4/1980 Sterk ..... F22B 1/025 122/32
4,204,305 A * 5/1980 Norton ..... B23P 15/26 29/890.043
4,266,600 A * 5/1981 Bieberbach ..... 165/76
4,576,228 A * 3/1986 Glatthorn ..... F28F 9/0131 165/162
5,158,162 A * 10/1992 Fink et al. ..... 188/378
5,323,736 A * 6/1994 Pascal ..... F22D 11/003 122/32
5,329,886 A * 7/1994 Sylvester ..... F22B 1/025 122/32
5,419,391 A * 5/1995 Chan ..... F28D 7/06 122/32
5,447,191 A * 9/1995 Boula ..... F22B 37/206 122/510
5,699,395 A * 12/1997 Sylvester ..... F22B 37/205 122/510
5,713,412 A * 2/1998 Wepfer ..... F16L 55/04 138/30
6,772,832 B2 * 8/2004 Schneider ..... 165/162
7,740,057 B2 * 6/2010 Wang ..... F28D 7/1607 165/159
7,771,674 B2 * 8/2010 Suzuta ..... B01J 8/067 165/159
8,695,688 B2 * 4/2014 Schneider ..... F28D 7/06 122/510
2003/0196786 A1 * 10/2003 Schneider ..... F22B 37/206 165/162
2004/0194932 A1 * 10/2004 Jensen ..... F28D 7/1669 165/135
2009/0008070 A1 * 1/2009 Inoue ..... F22B 1/162 165/162

* cited by examiner

STEAM GENERATOR TUBE LANE FLOW BUFFER

CROSS REFERENCE TO RELATED APPLICATIONS

This application claims priority to Provisional Application Ser. No. 61/471,328, filed Apr. 4, 2011, entitled STEAM GENERATOR TUBE LANE FLOW BUFFER.

BACKGROUND

1. Field

This invention relates generally to U-tube and shell steam generators and more particularly, to such generators that buffer the heat exchange tubes from the high velocity flow of recirculation fluid and feedwater within the tube lane.

2. Description of Related Art

A pressurized water nuclear reactor steam generator typically comprises a vertically oriented shell, a plurality of U-shaped tubes disposed in the shell so as to form a tube bundle, a tube sheet for supporting the tubes at the ends opposite the U-like curvature, a divider plate that cooperates with the tube sheet and a channel head forming a primary fluid inlet header at one end of the tube bundle and a primary fluid outlet header at the other end of the tube bundle. A primary fluid inlet nozzle is in fluid communication with the primary fluid inlet header and a primary fluid outlet nozzle is in fluid communication with the primary fluid outlet header. The steam generator secondary side comprises a wrapper disposed between the tube bundle and the shell to form an annular chamber made up of the shell on the outside and the wrapper on the inside and the feedwater ring disposed above the U-like curvature end of the tube bundle.

The primary fluid having been heated by circulation through the reactor enters the steam generator through the primary fluid inlet nozzle. From the primary fluid inlet nozzle, the primary fluid is conducted through the primary fluid inlet header, through the U-tube bundle, out the primary fluid outlet header and through the primary fluid outlet nozzle to the remainder of the reactor coolant system. At the same time, feedwater is introduced into the steam generator secondary side, i.e., the side of the steam generator interfacing with the outside of the tube bundle above the tube sheet, through a feedwater nozzle which is connected to a feedwater ring inside the steam generator. In one embodiment, upon entering the steam generator, the feedwater mixes with water returning from moisture separators. This mixture, called the downcomer flow, is conducted down the annular chamber adjacent the shell until the tube sheet located at the bottom of the annular chamber causes the water to change direction passing in heat transfer relationship with the outside of the U-tubes and up through the inside of the wrapper. While the water is circulating in heat transfer relationship with the tube bundle, heat is transferred from the primary fluid in the tubes to water surrounding the tubes causing a portion of the water surrounding the tubes to be converted to steam. To differentiate this steam/water mixture from the single phase downcomer flow, the fluid flow surrounding the tubes is designated as the tube bundle flow. The steam then rises and is conducted through a number of moisture separators that separate entrained water from the steam and the steam vapor then exits the steam generator and is typically circulated through a turbine to generate electricity in a manner well known in the art.

Since the primary fluid contains radioactive materials and is isolated from the feedwater only by the U-tube walls, the U-tube walls form part of the primary boundary for isolating these radioactive materials. It is, therefore, important that the U-tubes be maintained defect free by being well supported so that no breaks will occur in the U-tubes that will cause radioactive materials from the primary fluid to enter the secondary side, which would be an undesirable result. Support for the U-tubes is mainly accomplished by a plurality of transverse, spaced, tandem tube support plates that are positioned axially along the height of the tube bundle and through which the heat exchange tubes pass with their ends extending through and being affixed to the tube sheet. The holes in the support plates typically have lands that laterally support the heat exchange tubes, and lobes between the lands that permit the passage of the tube bundle flow and steam. However, tube wear has been reported at the tube support plates of steam generator units after extended periods of operation and possibly having tube and/or tube support plate fouling. The largest indications have a 28% depth. Of 79 total indications reported in one steam generator, 58, equivalent to 73% of the total number of indications, occur in rows 1-5 of the heat exchange tubes. Of these 79 total indications, 34% occur on row 1 tubes. Most of these occur at higher tube support plate elevations, where damping decreases and velocities are increased. These rows are adjacent to the tube lane region, centered between the tube hot and cold legs, and are subject to higher velocities and, thus, may experience turbulence-induced buffeting. It is well known that turbulence forces are attenuated rapidly within the first few rows of the heat exchange tubes, and the data evidences the presence of this phenomenon by the distribution of wear indications.

Accordingly, it is an object of this invention to reduce heat exchange tube wear at the tube support plates adjacent the tube lane in a tube and shell steam generator.

Furthermore, it is an object of this invention to reduce heat exchange tube wear within the vicinity of the tube support plates adjacent the tube lane without reducing the efficiency of the steam generator.

Additionally, it is an object of this invention to reduce heat exchange tube wear within the vicinity of the upper tube support plates within the first few rows of heat exchange tubes adjacent the tube lane.

SUMMARY

These and other objects are achieved by a tube and shell steam generator having a fluid header closed at one end by a first side of a tube sheet and separated into an inlet plenum and an outlet plenum by a divider plate. The steam generator has a plurality of U-shaped hollow heat exchange tubes respectively having a cold leg and a hot leg with the cold leg and the hot leg connected by a U-shaped bend section at one end and terminating respectively in an inlet section of the hot leg and an outlet section of the cold leg at another end with the inlet section of the hot leg extending through the tube sheet and opening into the inlet plenum and the outlet section of the cold leg extending through the tube sheet and opening into the outlet plenum. The steam generator further has a tube lane on a shell side of the tube sheet, opposite the first side, and centered between and having a side respectively adjacent the hot legs and the cold legs of the plurality of U-shaped hollow heat exchange tubes. The improvement is achieved, in combination with the foregoing elements, by a plurality of elongated buffer rods which extend within and on either side of the tube lane in a direction substantially perpendicular to the tube sheet. The buffer rods are supported in a manner that does not communicate with the primary fluid in the primary fluid header.

In one embodiment, the largest outside diameter of the buffer rods has substantially the same outside diameter as the U-shaped hollow heat exchange tubes. In another embodiment, the buffer rods have an axial length and the outside diameter of the buffer rods varies along the axial length. Preferably, the axial length varies in steps and the steam generator includes a plurality of spaced tube support plates, stacked in tandem and respectively oriented transverse to the axial length of the buffer rods and wherein the largest diameter of the buffer rods is at the tube support plate in which the buffer rods extend, that is furthest away from the tube sheet.

In still another embodiment, the buffer rods are connected at one end to the tube sheet. Preferably, the buffer rods extend into the tube sheet without extending through the tube sheet.

In a further embodiment, the steam generator has an axial dimension that extends away from the primary fluid header, perpendicular to the tube sheet and further includes a plurality of spaced tube support plates, stacked in tandem and respectively oriented transverse to the axis, through which the tube hot legs and tube cold legs pass. The buffer rods extending between at least some of the tube support plates. Preferably, the buffer rods extend from the tube sheet through substantially all of the tube support plates.

In one embodiment, at least a portion of the axial length of the buffer rods is hollow and the hollow portion of the buffer rods has a wall thickness which is at least equal to or greater than a wall thickness of the plurality of U-shaped hollow heat exchange tubes. In still another embodiment, the buffer rods are solid.

Alternately, the buffer rods may start extending from an elevation above the tube sheet and may terminate below an uppermost tube support plate. Additionally, the buffer rods may extend through holes in at least two adjacent tube support plates wherein at least some of the holes through which the buffer rods extend in one of the two adjacent tube support plates are offset from the corresponding holes in another of the two adjacent tube support plates. Preferably, the offset is up to approximately four millimeters.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENT

Figure 1:
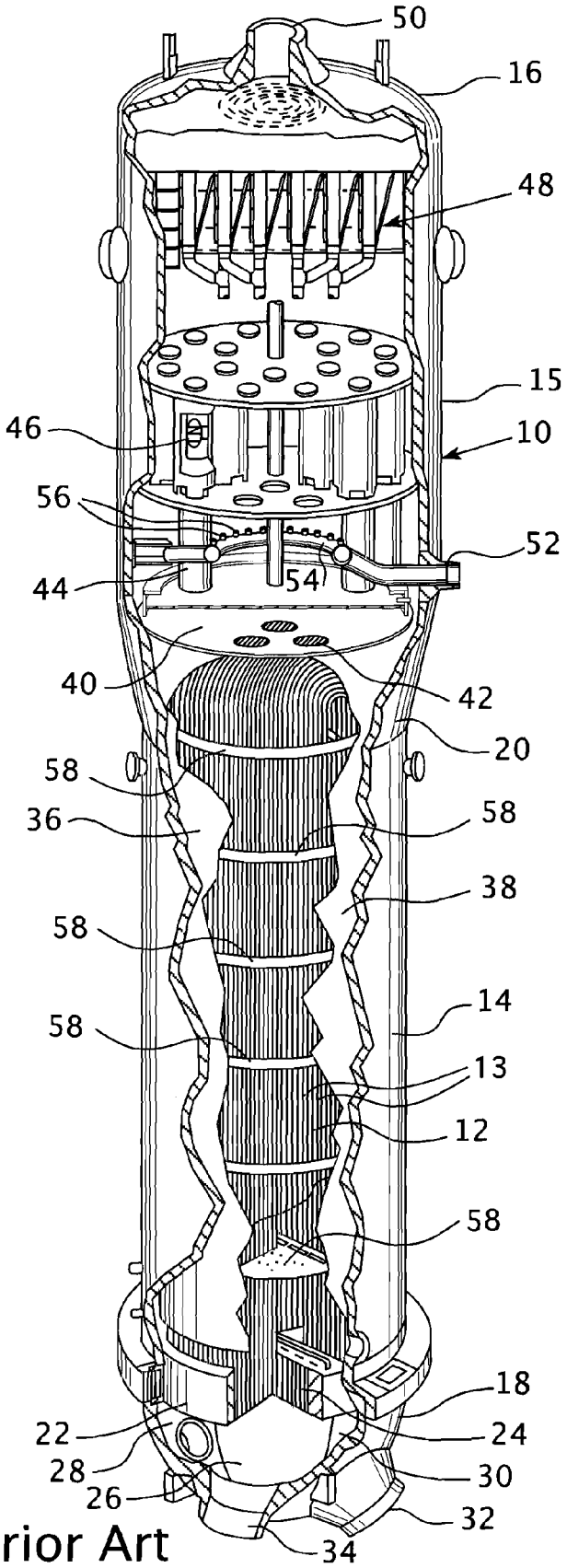
FIG. 1 Prior Art
FIG. 1 is a perspective view, partially cut away, of a vertical tube and shell steam generator.

Referring now to the drawings, FIG. 1 shows a steam or vapor generator 10 that utilizes a plurality of U-shaped tubes which form a tube bundle 12 to provide the heating surface required to transfer heat from a primary fluid to vaporized or boil a secondary fluid. The steam generator 10 comprises a vessel having a vertically oriented tubular shell portion 14 and a top enclosure or dished head 16 enclosing the upper end and a generally hemispherical shaped channel head 18 enclosing the lower end. The lower shell portion 14 is smaller in diameter than the upper shell portion 15 and a frustoconical shaped transition 20 connects the upper and lower shell portions. A tube sheet 22 is attached to the channel head 18 and has a plurality of holes 24 disposed therein to receive ends of the U-shaped tubes 13. A divider plate 26 is centrally disposed within the channel head 18 to divide the channel head into two compartments 28 and 30, which serve as headers for the tube bundle 12. Compartment 30 is the primary fluid inlet compartment and has a primary fluid inlet nozzle 32 in fluid communication therewith. Compartment 28 is the primary fluid outlet compartment and has a primary fluid outlet nozzle 34 in fluid communication therewith. Thus, primary fluid, i.e., the reactor coolant which enters fluid compartment 30, is caused to flow through the tube bundle 12 and out through outlet nozzle 34.

The tube bundle 12 is encircled by a wrapper 36 which forms an annular passage 38 between the wrapper 36 and the shell and cone portions 14 and 20, respectively. The top of the wrapper 36 is covered by a lower deck plate 40 which includes a plurality of openings 42 in fluid communication with a plurality of larger tubes 44. Swirl vanes 46 are disposed within the larger tubes 44 to cause steam flowing therethrough to spin and centrifugally remove some of the moisture contained within the steam as it flows through this primary centrifugal separator. The water separated from the steam in this primary separator is returned to the top surface of the lower deck plate 40. After flowing through the centrifugal separator, the steam passes through a secondary separator 48 before reaching a steam outlet nozzle 50 centrally disposed in the dish head 16.

The feedwater inlet structure of this generator includes a feedwater inlet nozzle 52 having a generally horizontal portion called a feedring 54 and a plurality of discharge nozzles 56 elevated above the feedring. Feedwater, which is supplied through the feedwater inlet nozzle 52, passes through the feedwater ring 54 and exits through discharge nozzles 56, and in one prior art embodiment, mixes with water which was separated from the steam and is being recirculated. The mixture then flows down from above the lower deck plate 40 into the annular downcomer passage 38. The water then enters the tube bundle 12 at the lower portion of the wrapper 36 and flows among and up the tube bundle where it is heated to generate steam.

Figure 2:
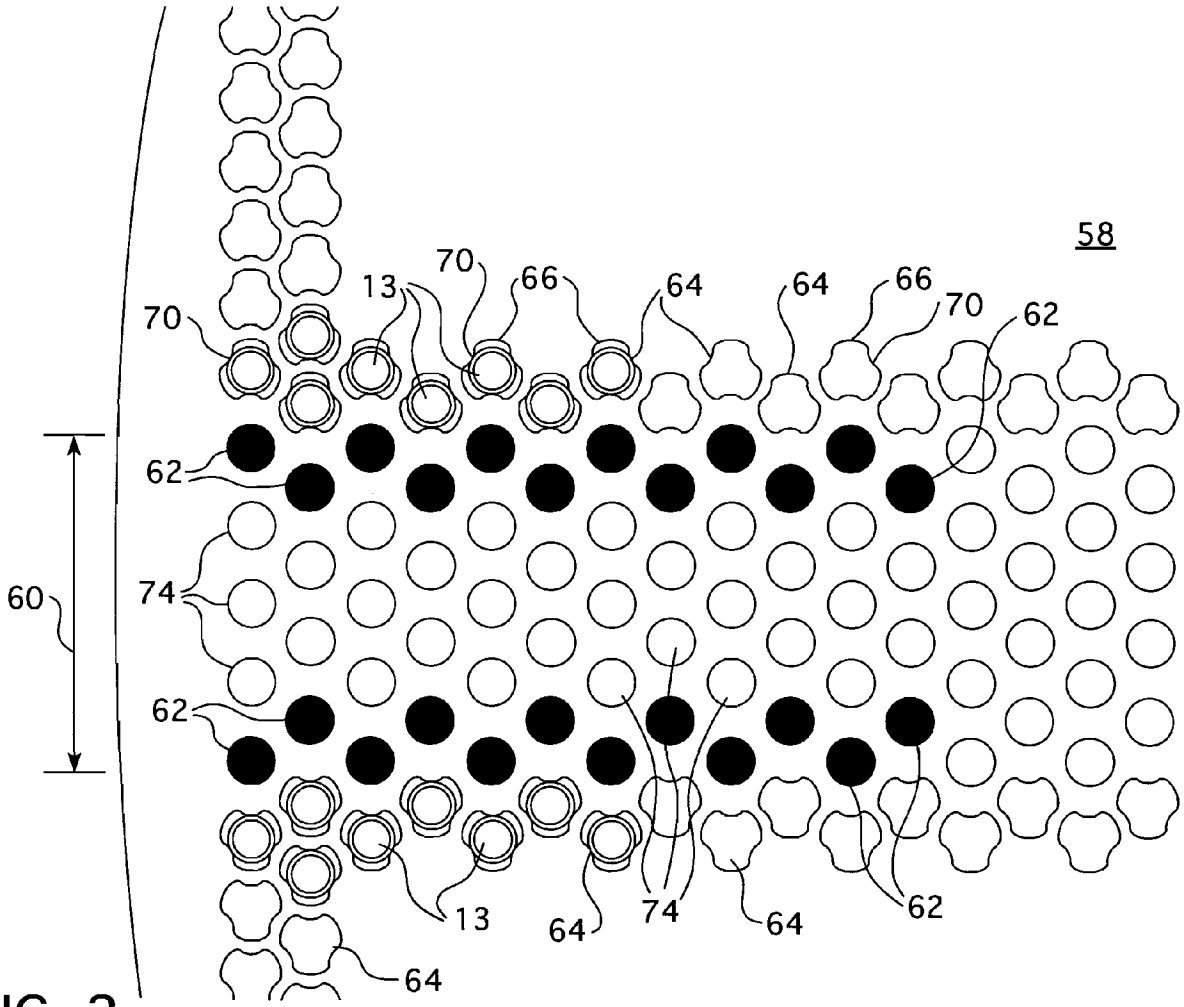
FIG. 2 is a plan view showing a portion of one of the tube support plates around the tube lane area, with buffer rods inserted through flow holes extending on either side of the tube lane.

The boiling action of the water and the flow of fluids pass the heat exchange tubes can cause fluidelastic excitation that can result in vibrations of the heat exchange tubes which can accelerate their wear. A plurality of tandemly spaced heat exchange tube support plates 58 are positioned transverse to the axial dimension of the shell 14 and have holes through which the heat exchange tubes extend. The holes are specifically designed to both support the heat exchange tubes and provide openings for the feedwater and recirculation stream to pass therethrough. FIG. 2 shows a plan view of a portion of a heat exchange tube support plate in the area of the tube lane which extends below the U-bend region of the heat exchange tubes. Heat transfer tubes 13 are illustrated in several of the rows 1, 2 and 3 tube holes 64. Heat exchange tubes 13 are shown within several but not all of the broached holes 64, though, it should be understood, that the heat exchange tubes extend through substantially each of the broached holes that are shown. The tubes 13 are supported on the lands 70 of the holes 64 and the coolant flow is conducted around the tubes through the lobes 66. Rows 1, 2 and 3 are the most susceptible to turbulence induced vibration and wear, which result from transverse flow in the central tube lane 60. Thus, the heat exchange tubes 13 in rows 1, 2 and 3 experience turbulence heightened induced buffeting. Heat exchange tube wear data collected from operating generators validates that the turbulent forces are attenuated rapidly within the first few rows of the heat exchange tubes 13. The flow holes 74 closer to the center line of the tube support plate limits streaming of water through the tube lane region of the tube bundle and distribute flow prior to entry into the U-bend cross flow region. Flow slots are used in place of the flow holes 74 for the lower tube support plates.

Figure 3:
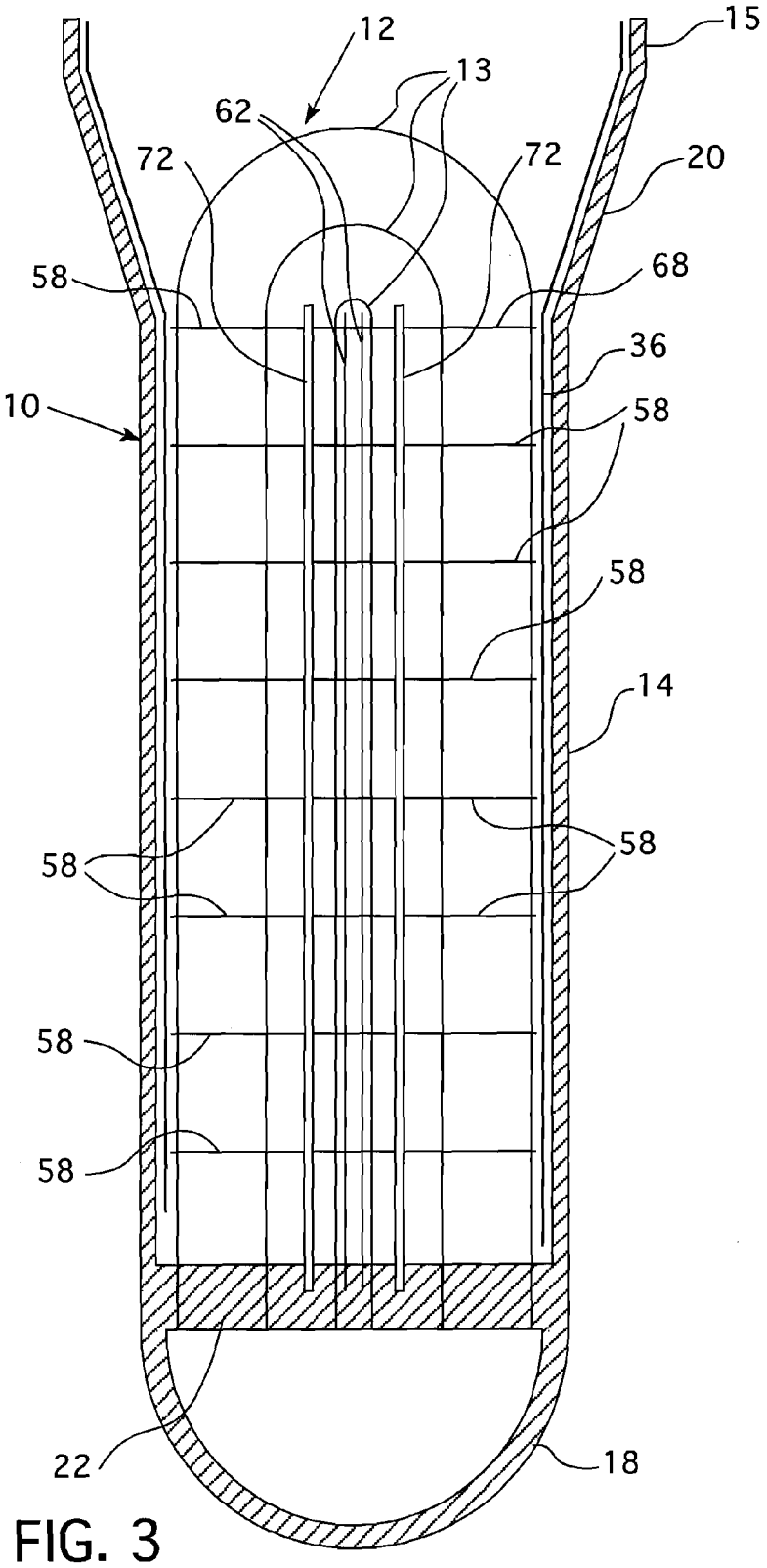
FIG. 3 is a side view, partially in section, of a schematic of a lower portion of a steam generator showing the buffer rods of this invention extending from the tube sheet up through the upper tube support plate.

In accordance herewith, elongated buffer rods 62 extend through the flow holes 74 on either side of the tube lane 60 and substantially shield rows 1, 2 and 3 of the heat exchange tubes 13 from being buffeted by the water passage through and transverse to the flow holes 74. Thus, the tube lane flow buffers 62 are located between the streaming tube free region along the tube lane 60 and have the effect of attenuating lateral velocities that occur when the flow through the tube lane passes by and/or impinges on each successive tube support plate 58. The buffer rods 62 may be supported laterally by round holes such as the flow holes 74 or broached holes such as the tube support holes 64, and may be fabricated out of stainless steel or another erosion/corrosion-resistant material. In the preferred embodiment, the flow buffer rods 62 will extend from the tube sheet 22 secondary face to a few inches past the uppermost tube support plate 68. FIG. 3 schematically shows a cross section of the lower portion of a steam generator containing the tube bundle 12 with only a representative number of U-shaped tubes being shown. In this example, eight support plates 58 are arranged in tandem, spaced along the axis of the generator. The tube support plates are laterally supported by a plurality of stay rods 72 that are attached to the tube sheet 22 at their lower ends either by welding or being screwed into a threaded recess within the upper face of the tube sheet. The stay rods extend from the tube sheet through round openings in each of the tube support plates 58 terminating a short distance above the upper support plate 68. While, for purpose of illustration, only two stay rods 72 are shown in FIG. 3, in actuality, a substantial number of additional stay rods are provided amongst the hot and cold legs of the heat exchange tubes 13 to support the tube support plates against lateral movement. Similarly, in this preferred embodiment, the buffer rods 62 extend from recesses in the upper face of the tube sheet 22, where they can be similarly affixed and extend up a few inches above the upper tube support plate 68. Preferably, the buffer rods 62 are fabricated with the same diameter as the heat exchange tubing 13, so there will be no impediment to service operations such as in-bundle inspections or sludge lancing, and the rods will appear no different than two additional rows of tubes. The reduction in width of the tube lane resulting from the presence of the buffer rods will not affect serviceability since the width of the tube lane will remain wider than that of the most limiting steam generator units.

Figure 4:
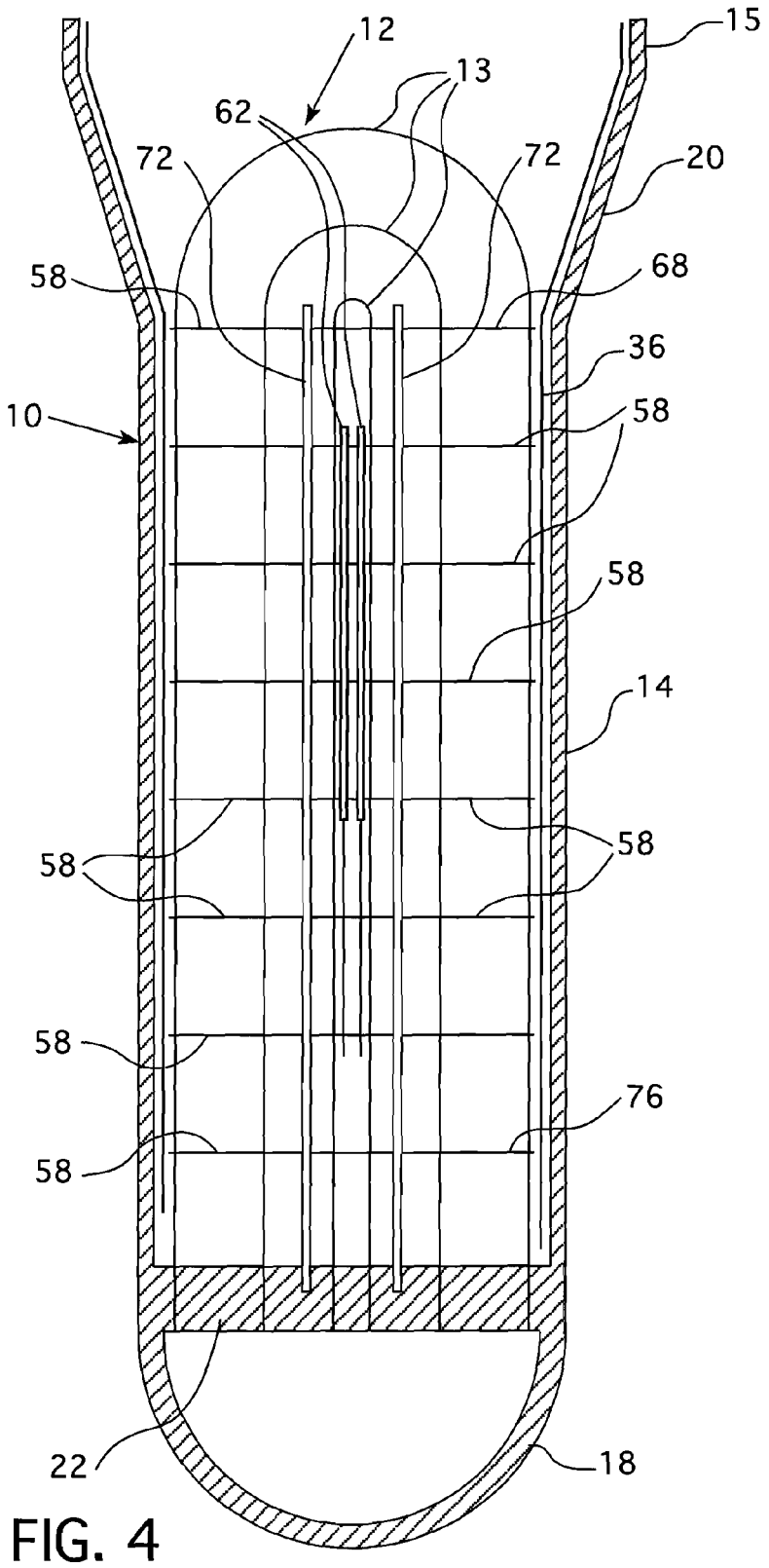
FIG. 4 is a schematic, partially in section, of the lower portion of a steam generator showing the buffer rods extending from above the tube sheet through a plurality of tube support plates below the upper most tube support plate.

FIG. 4 shows the steam generator schematic previously illustrated in FIG. 3 with the buffer rods 62 extending from an elevation above the tube sheet 22, and in this case, above the lowermost heat exchange tube support plate 76, to an elevation just above the heat exchange tube support plate 58 below the upper most heat exchange support plate 68. In addition, the buffer rods 62 are shown as having a step diameter with the larger diameter extending through the upper heat exchange tube support plates 58 to provide more protection against buffeting in the areas of greater turbulence. Furthermore, the buffer rods 62 can be thick walled, as compared to the heat exchange tube walls as shown in the upper extent of the buffer rods illustrated in FIG. 4 or solid as illustrated in FIG. 3. Additionally, the buffer rod and heat exchange tube support holes' center line positions in alternating tube support plates may be offset by as much as four millimeters to further control vibration of both the buffer rods 62 as well as the heat exchange tubes 13. This will provide light preloads that will help eliminate impacting wear, which has higher wear rates than fretting-type wear.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A tube and shell steam generator for transferring heat from a primary fluid to a secondary fluid, the steam generator comprising:

a primary fluid header closed at one end by a first side of a tube sheet and separated into an inlet plenum and an outlet plenum by a divider plate;

a plurality of U-shaped hollow heat exchange tubes, respectively, substantially all of which have a diameter and pitch and a cold leg and a hot leg, with the cold leg and the hot leg connected by a U-shaped bend section at one end and terminating respectively in an inlet section of the hot leg and an outlet section of the cold leg at another end with the inlet section of the hot leg extending through the tube sheet and opening into the inlet plenum and the outlet section of the cold leg extending through the tube sheet and opening into the outlet plenum;

a linear tube lane on a shell side of the tube sheet, opposite the first side, and centered between and having a side respectively adjacent the hot legs and the cold legs of the plurality of U-shaped hollow heat exchange tubes and extending completely across the plurality of U-shaped heat exchange tubes; and a plurality of elongated flow buffer rods extending within and on either side of the tube lane in a direction substantially perpendicular to the tube sheet, the flow buffer rods not communicating with the primary fluid in the primary fluid header and having substantially the same diameter as the U-shaped hollow heat exchange tubes at elevations along the U-shaped tubes having relatively greater turbulence than other elevations along the U-shaped tubes and the same pitch as the pitch of the U-shaped hollow heat exchange tubes.

2. The tube and shell steam generator of claim 1 wherein the largest outside diameter of the flow buffer rods has substantially the same outside diameter as the U-shaped hollow heat exchange tubes along the entire length of the flow buffer rods.

3. The tube and shell steam generator of claim 1 wherein the flow buffer rods have an axial length and the outside diameter of the flow buffer rods varies along the axial length of the flow buffer rods.

4. The tube and shell steam generator of claim 3 wherein the axial length varies in steps with adjacent steps having a different diameter from one another.

5. The tube and shell steam generator of claim 4 including a plurality of spaced tube support plates, stacked in tandem and respectively positioned transverse to the axial length of the flow buffer rods and wherein each different diameter extends substantially for an entire length between at least two adjacent support plates and the largest diameter of the flow buffer rods is at the tube support plate into which the flow buffer rods extend, that is furthest away from the tube sheet.

6. The tube and shell steam generator of claim 1 wherein the flow buffer rods are connected at one end to the tube sheet.

7. The tube and shell steam generator of claim 6 wherein the flow buffer rods extend into the tube sheet without extending through the tube sheet.

8. The tube and shell steam generator of claim 1 wherein the steam generator has an axial dimension that extends away from the primary fluid header, perpendicular to the tube sheet and further includes a plurality of spaced tube support plates, stacked in tandem and respectively positioned transverse to the axis, through which the hot legs and cold legs pass, the flow buffer rods extending between at least some of the tube support plates.

9. The tube and shell steam generator of claim 8 wherein the flow buffer rods extend from the tube sheet through substantially all of the tube support plates.

10. The tube and shell steam generator of claim 8 wherein at least a portion of the axial length of the flow buffer rods is hollow and the hollow portion of the flow buffer rods has a wall thickness which is at least equal to or greater than a wall thickness of the plurality of U-shaped hollow heat exchange tubes.

11. The tube and shell steam generator of claim 8 wherein the flow buffer rods are solid.

12. The tube and shell steam generator of claim 8 wherein the flow buffer rods start extending from an elevation above the tube sheet.

13. The tube and shell steam generator of claim 8 wherein the flow buffer rods extensions terminate below an uppermost tube support plate.

14. The tube and shell steam generator of claim 8 wherein the flow buffer rods extend through holes in at least three adjacent support plates and at least some of the holes through which the flow buffer rods extend in alternate ones of the adjacent tube support plates are offset from the corresponding holes in another of the adjacent support plates.

15. The tube and shell steam generator of claim 14 wherein the offset is up to approximately 4 mm.

* * * * *